US007631649B2

(12) United States Patent
Coral et al.

(10) Patent No.: US 7,631,649 B2
(45) Date of Patent: Dec. 15, 2009

(54) HAIR GRIP WITH A CONNECTION WORKING IN ELONGATION

(75) Inventors: Hilaire Coral, Oyonnax (FR); Jean-Pierre Veiniere, Arbent (FR)

(73) Assignee: Hilaire Coral, Oyonnax (FR)

( * ) Notice: Subject to any disclaimer, the term of this patent is extended or adjusted under 35 U.S.C. 154(b) by 0 days.

(21) Appl. No.: 11/376,381

(22) Filed: Mar. 15, 2006

(65) Prior Publication Data

US 2006/0219255 A1 Oct. 5, 2006

Related U.S. Application Data

(63) Continuation of application No. PCT/EP2004/051790, filed on Aug. 13, 2004.

(51) Int. Cl.
*A45D 8/20* (2006.01)

(52) U.S. Cl. ..... 132/277; 132/273

(58) Field of Classification Search ..... 132/267, 132/277, 128, 132, 138, 144, 156, 279, 283; 24/500, 501; D28/39, 40
See application file for complete search history.

(56) References Cited

U.S. PATENT DOCUMENTS

| | | | | |
|---|---|---|---|---|
| 2,464,739 | A | 3/1949 | Solomon | |
| 2,641,266 | A | 6/1953 | Thatcher | |
| 5,535,765 | A | 7/1996 | Takashima | |
| 5,609,169 | A | 3/1997 | Yang | |
| 6,047,705 | A * | 4/2000 | Hawley | 132/128 |
| 6,186,151 | B1 | 2/2001 | Newlin | |
| 2004/0149306 | A1 | 8/2004 | Rogers | |
| 2007/0028940 | A1 * | 2/2007 | Coral | 132/277 |

FOREIGN PATENT DOCUMENTS

| | | |
|---|---|---|
| DE | 29821981 | 2/1999 |
| FR | 2298257 | 8/1976 |

* cited by examiner

*Primary Examiner*—Robyn Doan
*Assistant Examiner*—Rachel R Steitz
(74) *Attorney, Agent, or Firm*—Westerman, Hattori, Daniels & Adrian, LLP

(57) ABSTRACT

Hair grip comprising two jaws (1, 3) articulated about a joint (61, 62; 81, 82; 54; 29) for relative displacement into an open or closed position and a connection (11) joining each jaw to exert a return force by a deformation in elongation against the displacement of the two jaws from the closed position to the open position in order to return the two jaws to the closed position.

According to the invention, the connection is produced in an elastomer material having a Shore A hardness of between 60 and 90 and the two jaws (1, 3) are provided with perforations (22, 24) through which the connection (11) is introduced at one free end to be fixed to the two jaws by fixing means.

Preferably the fixing means consist of an attached part engaging the free end of the connection (11), more preferably a U-shaped clip.

18 Claims, 16 Drawing Sheets

HAIR GRIP WITH A CONNECTION WORKING IN ELONGATION

CROSS REFERENCE TO RELATED APPLICATIONS

This application is a Continuation application of PCT/EP2004/051790 filed Aug. 13, 2004, which claims priority of Application Nos. FR03.02720 filed Sep. 15, 2003 and EP04/050203 filed Feb. 24, 2004, which are included in their entirety by reference made hereto.

TECHNICAL FIELD

The invention relates to a hair grip comprising more particularly two jaws articulated for relative displacement into an open or closed position and a connection joining each jaw to exert a return force by a deformation in elongation against the displacement of the two jaws from the closed position to the open position, in order to return the two jaws to the closed position.

PRIOR ART

A clothes peg having a similarity with this type of hair grip is known from the document GB 829 677. The connection consists of a helical spring with close wound coils. Each jaw is provided with a blind hole of which one part is threaded to receive each end of the helical spring by screwing-in. In this arrangement, the spring is masked by the two jaws. One end of the helical spring is easily screwed into one of the two jaws. Nevertheless, screwing the opposing end into the other jaw appears to be more complicated, in that it can no longer be screwed in when the two jaws are brought together sufficiently to be articulated to one another about a joint pin. This is the reason why it appears necessary, according to this document, to screw the second jaw onto the opposing end of the helical spring, whilst exerting traction on this helical spring to maintain the two jaws separate from one another until the screwing is completed, then releasing the traction to bring the two jaws back into contact with one another and to join them about the joint pin. It therefore appears that the assembly of the clothes peg disclosed in this document is relatively complicated and requires dexterity.

The positioning of the connection seems more simple in a hair grip known from the document U.S. Pat. No. 2,641,266. The connection consists of a self-closing rubber band. It is mounted around two jaws by being arranged on the side opposing the two lever arms of each jaw relative to the joint. Nevertheless, in this arrangement, the connection is visible and moreover exerts the return force in any open position of the hair grip. In other words, a force has to be exerted continuously on the lever arms to maintain the hair grip in the open position. A certain amount of discomfort can result for a user, all the more marked the greater the breadth of opening of the hair grip.

DISCLOSURE OF THE INVENTION

One of the objects of the invention is to remedy the drawbacks which have just been described.

To this end, the object of the invention is a hair grip comprising two jaws articulated about a joint for relative displacement into an open or closed position and a connection joining each jaw to exert a return force by a deformation in elongation against the displacement of the two jaws from the closed position to the open position, in order to return the two jaws to the closed position, characterised in that the joint is provided with a passage to permit the connection to cross the joint once the two jaws are displaced from the closed position to the open position to exert a return force for returning the two jaws to the open position.

When the connection has crossed the joint, the return force which it exerts on the two jaws maintains them in a stable open position. It is therefore possible for a user to prepare the positioning of the hair grip, by opening it into the stable open position. By means of this arrangement, it is no longer necessary to provide lever arms.

A further object of the invention is a hair grip comprising two jaws articulated for relative displacement into an open or closed position and a connection tensioned between the jaws to exert a return force by a deformation in elongation against the displacement of the two jaws from the closed position to the open position, in order to return the two jaws to the closed position, characterised in that the two jaws are provided with perforations through which the connection is introduced at one free end to be fixed to the two jaws by fixing means.

The perforations allow one free end of the connection to be introduced and then to be fixed to the two jaws whilst the latter are articulated relative to one another and bear against one another in the closed position of the hair grip. As a result, the tensioning of the connection is simplified. Furthermore, the connection tensioned between the two jaws is masked by the joint, in particular in the closed position of the hair grip.

The invention relates finally to a hair grip comprising two jaws articulated about a joint for relative displacement into an open position or closed position and a self-closing connection exerting a return force by a deformation in elongation against the displacement of the two jaws from the closed position to the open position, in order to return the two jaws to the closed position, characterised in that the connection is housed in two joint supports fixed to the jaws by two feet and joined by two heads which extend in a joint direction above the feet to mask the connection in the closed position.

BRIEF DESCRIPTION OF THE DRAWINGS

Further advantages of the invention will appear from reading the description of embodiments shown below by the drawings, in which.

EMBODIMENTS(S) OF THE INVENTION

With reference to FIGS. 1 to 24 and 29 to 37, a hair grip comprises two jaws 1 and 3 articulated for relative displacement into an open position.

According to a first embodiment of the invention, FIGS. 1 to 15, a connection 11 is fixed onto the jaws 1 and 3 and is tensioned therebetween to exert a return force by a deformation in elongation against the displacement of the two jaws 1 and 3, in order to return them to a closed position.

Figure 1:
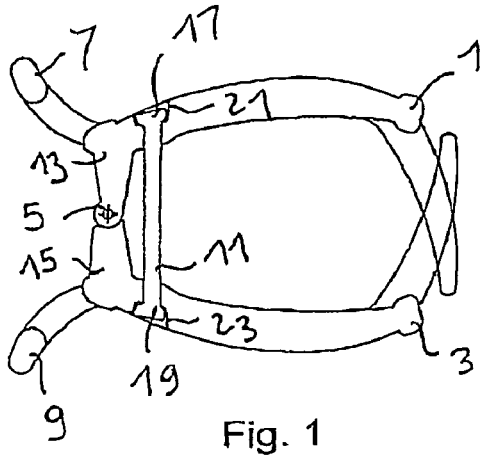
FIGS. 1 to 3 show a hair grip according to a first embodiment of the invention, respectively as a profile view, in the closed position and the open position, and as a rear view, in the closed position. The grip shown by the Figures has a pin, lever arms of a part with the jaws and a connection arranged relative to the jaws to undergo increased deformation in the open position.
Figure 3:
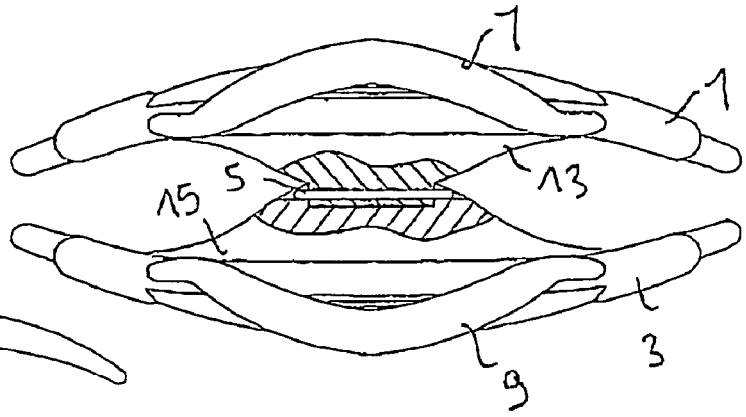

In the embodiment shown by FIGS. 1 and 3, the two jaws 1 and 3 are articulated by a pin 5 carried by two pin supports 13 and 15, each fixed to a jaw and are displaced by means of lever arms 7 and 9, each fixed to a jaw. The connection 11 is fixed onto each jaw 1 or 3 and tensioned on the side opposing the lever arms 7 and 9 relative to the pin 5 without it being necessary to make it pass through apertures formed in these lever arms. As a result, the arrangement of the lever arms relative to the jaws is simplified.

The connection 11 is provided with bulges 17 and 19 to be received in notches 21 and 23 formed in the jaws 1 and 3. The connection is positioned by compressing the bulges 17 and 19 to introduce them through passage sections 22 and 24, in other words perforations, opening out into the notches 21 and 23. The bulges 17 and 19 extend, for example, from a wedge or a bead formed on one or two ends of the connection 11.

Figure 27:
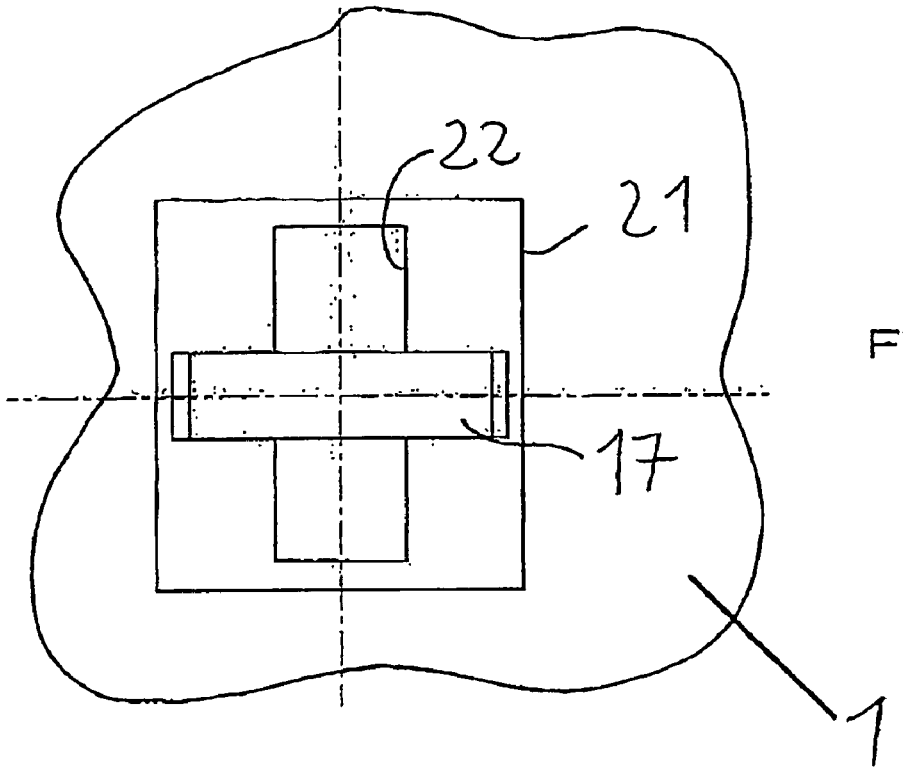
FIGS. 27 and 28 show respectively in plan view and in section a second means of fixing the connection to the jaws of the hair grip according to the first or second embodiment of the invention.
Figure 28:
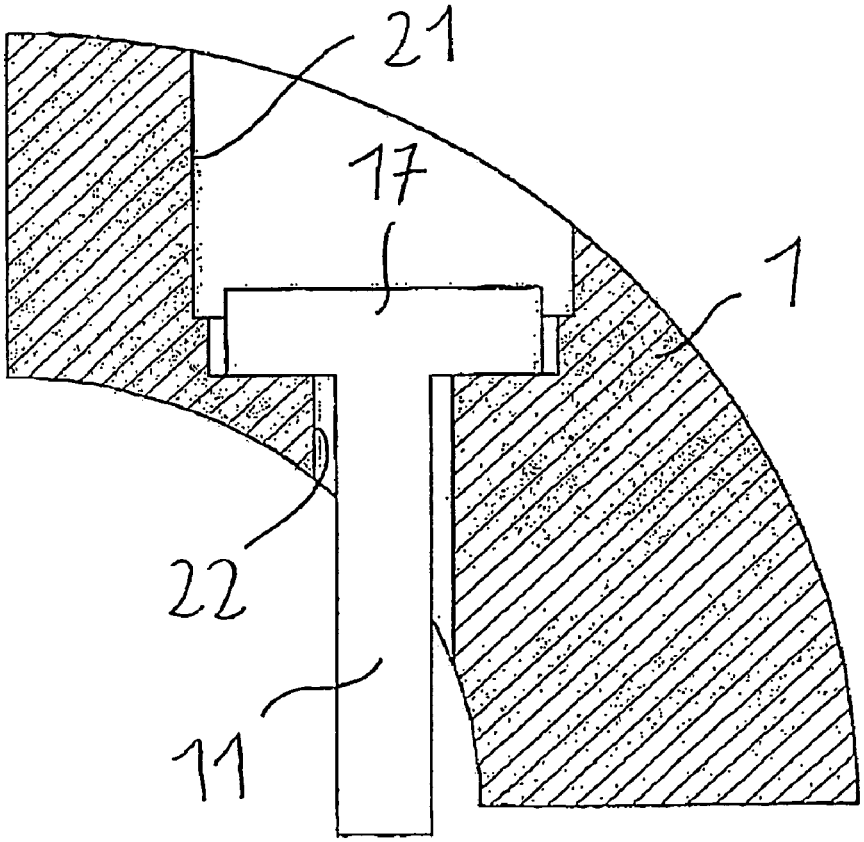
Figure 29:
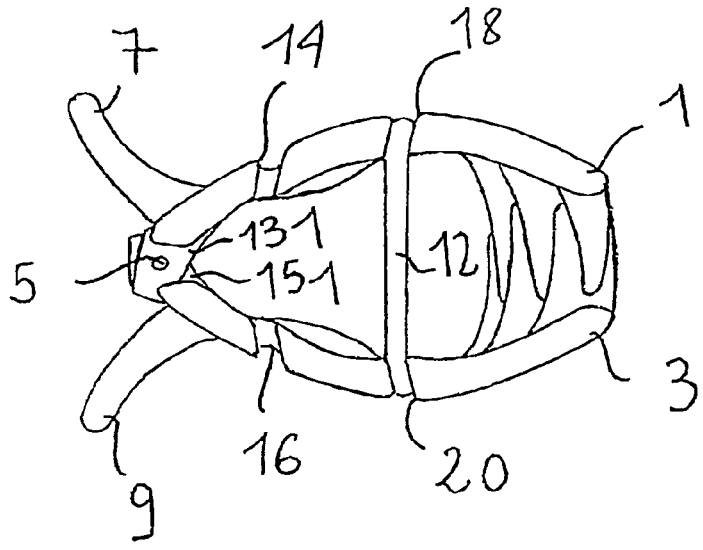
FIGS. 29 to 33 show a hair grip according to a third embodiment of the invention, respectively as a profile view, in the closed position and in the open position, as a rear view in the closed position, as a plan view in the open position and one of the jaws constituting the grip, as a plan view. The grip shown by these Figures has a joint pin, lever arms of a part with the jaws and a self-closing connection arranged relative to the jaws to grip the hair of the user in the closed position.
Figure 30:
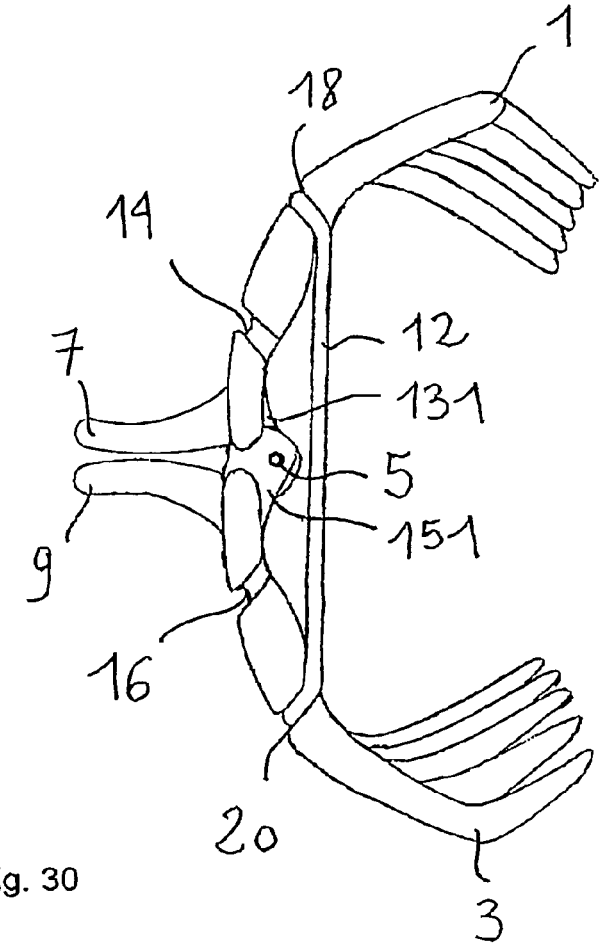

To facilitate the compression of the bulges 17 and 19 during their introduction through the perforations 22 and 24, it is provided to form recesses in the bulges, for example slots or cavities. In FIGS. 27 and 28 it is also provided to position the connection through the perforations without compressing the bulges but simply by making the connection 11 turn in the notches 21 and 23 so that the bulges 17 and 19 are arranged to bear against the notches 21 and 23 in a direction where the perforations 22 and 24 are narrower than in the direction where the bulges are introduced through these perforations.

The perforations 22 and 24 may furthermore each comprise a first section adapted to the passage of bulges of the connection 11 and a second section narrower than the bulges 17 and 19 to retain the latter relative to the jaws 1 and 3.

Preferably, only one end of the connection 11 is provided with a bulge 21 to allow the opposing end to be introduced into the passage sections 22 and 24 of the notches 21 and 23 without requiring compression of this opposing end. The fixing of this end of the connection 11 is then ensured by a fixing means 26, for example a U-shaped part, for example made of metal, engaging this end to block the connection 11 in the corresponding notch 19. It is further provided to fix the connection to each jaw by means of a U-shaped part engaging each of the two ends of the connection to retain it in each of the corresponding notches. This means of fixing the connection is shown by FIGS. 10 to 25, this last Figure showing in detail the arrangement of the U-shaped part engaging one end of the connection. Fixing parts other than a U-shaped part are also suitable for fixing the connection 11 to each of the jaws 1 and 3 of the hair grip, in particular a metal gripping part or a clip.

The connection 11 introduced into the passage sections 22 and 24 of the jaws 1 and 3 can also be fixed to the latter by a pin introduced into a perforation of the connection or by corresponding notches formed on one end of the connection 11 and received in corresponding notches formed in the passage sections 22 and 24. It is further provided to fix the connection emerging from the passage sections by bonding it or by welding it to the two jaws 1 and 3.

The connection 11 arranged on the side opposing the lever arms 7 and 9 relative to the joint pin 5 is masked by the pin supports 13 and 15 in the closed position in particular, as is clearly visible in FIG. 3. Finally, the deformation in elongation of the connection 11 is accompanied by a return force exerted in a symmetrical manner relative to the joint pin 5 on each jaw 1 or 3.

Figure 4:
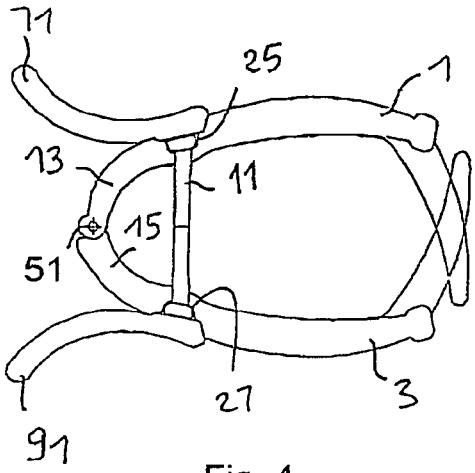
FIGS. 4 to 6 correspond to FIGS. 1 to 3 above for a grip distinguished by lever arms attached to the jaws.
Figure 6:
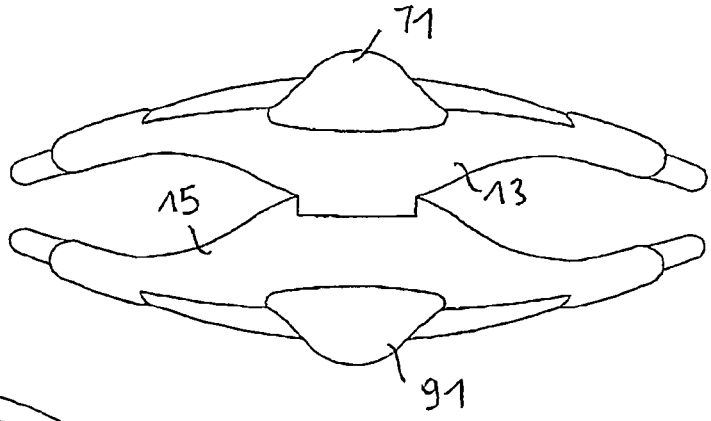
Figure 5:
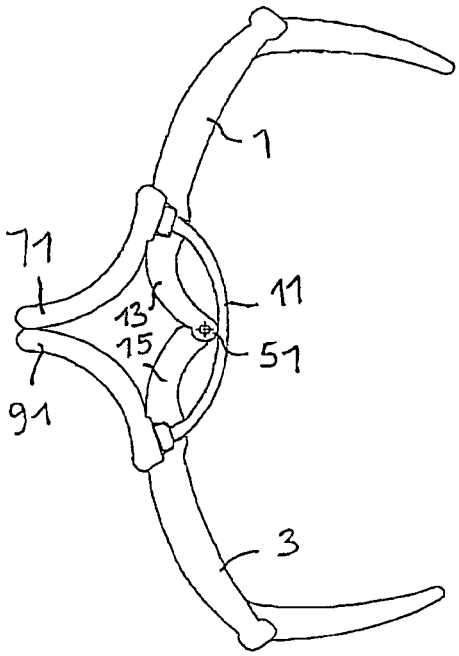

The hair grip shown in FIGS. 4 to 6 is distinguished from that described above by the lever arms 71 and 91 being attached to the jaws 1 and 3.

Preferably, the lever arms 71 and 91 are attached to the jaws by resilient gripping of lugs 25 and 27 in the notches and advantageously in the notches 21 and 23 provided to receive the resilient connection 11. By this arrangement, the fixing means of the connection received in the notches is masked and the aesthetic character of the hair grip is therefore enhanced.

Figure 7:
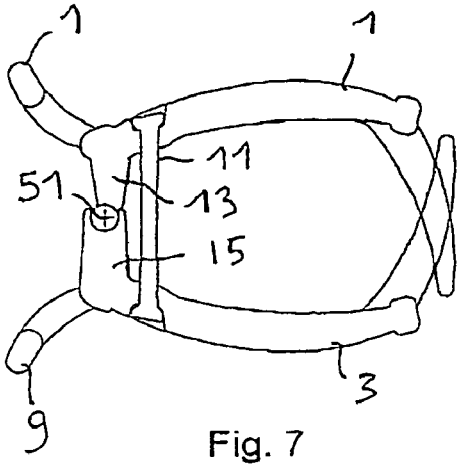
FIGS. 7 to 9 correspond to FIGS. 1 to 3 above for a grip distinguished by a cylindrical linkage with resilient gripping.
Figure 9:
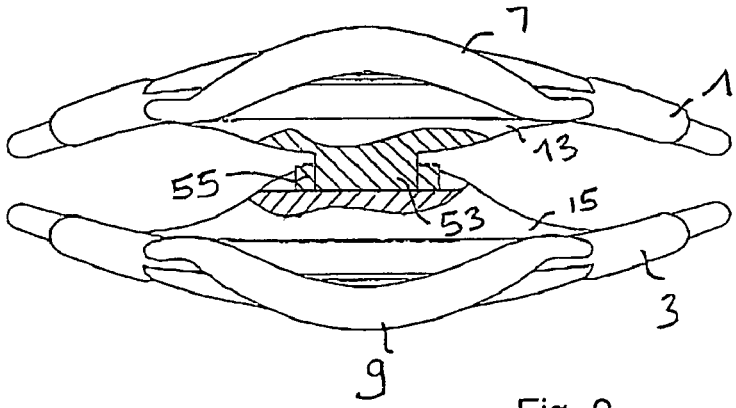
Figure 8:
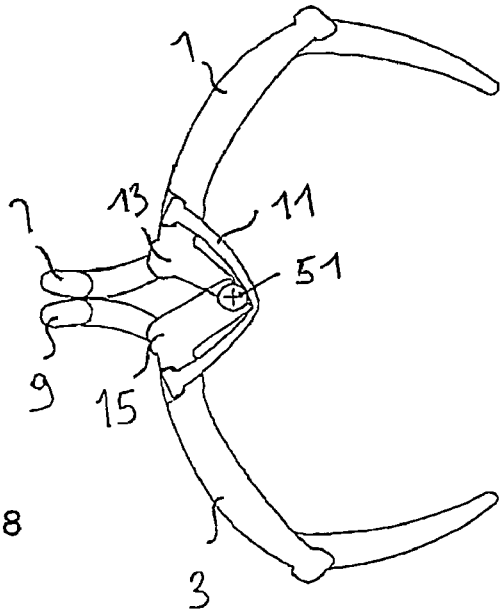

The hair grip shown by FIGS. 7 to 9 is distinguished from those described above in that the joint in this case is formed by a cylindrical linkage 51. In the example shown, a first cylinder 53 projects from one of the pin supports 13 of one of the two jaws 1 and is inserted into a second cylinder 55 formed with a hollowed out portion in the other pin support 15 of the other jaw 3. Preferably the projecting cylinder 53 fixed to one 13 of the pin supports of one of the two jaws 1 is inserted by resilient gripping in the second cylinder 55 formed with a hollowed out portion in the other pin support 15 of the other jaw 3. This arrangement allows the two jaws of the hair grip to be rapidly and easily assembled.

Figure 2:
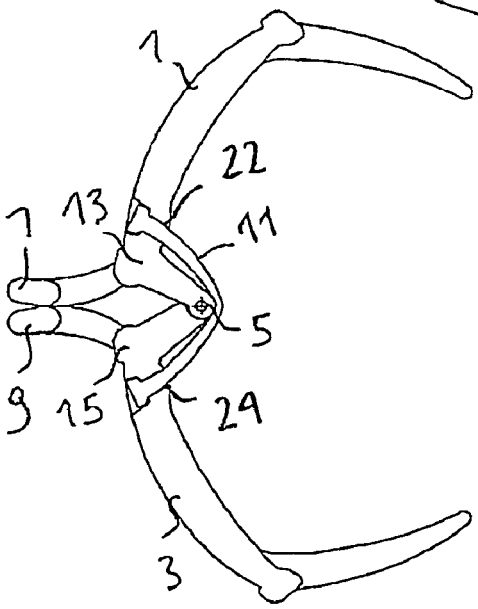

In the embodiments shown by FIGS. 1 to 9, the connection 11 is arranged so as to undergo an increase in deformation in elongation created by the pin supports 13 and 15, as the two jaws are displaced into the open position, FIG. 2, 5 or 8. By this arrangement, the deformation in elongation is increased to exert a greater return force of the two jaws in the closed position.

Figure 10:
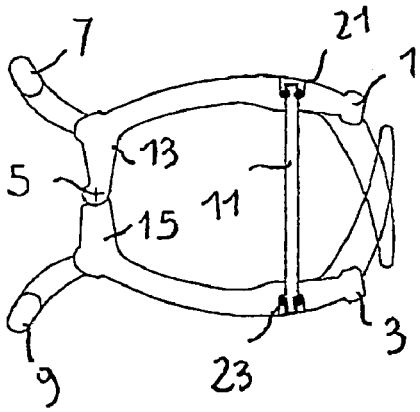
FIGS. 10 to 12 correspond to FIGS. 1 to 3 for a grip distinguished by a connection arranged relative to the jaws to grip the hair of the user in the closed position.
Figure 12:
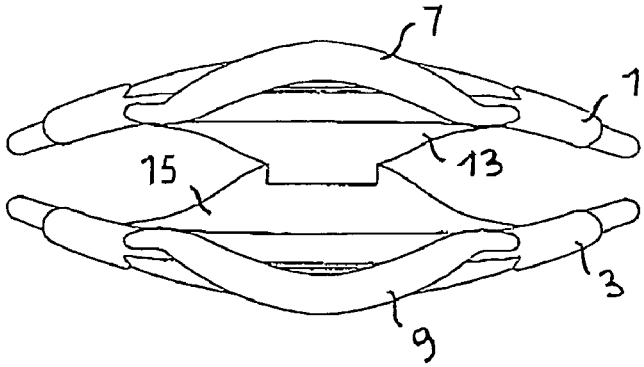
Figure 11:
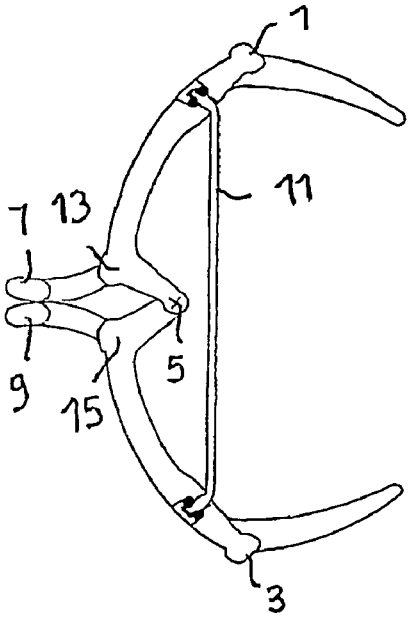

The hair grip shown by FIGS. 10 to 12 is distinguished from the grip described in FIGS. 1 to 9 by the connection 11 being arranged relative to the jaws 1 and 3, such that the hair of the user is gripped in the closed position. As is visible in the Figures, the connection is arranged approximately at an equal distance from the jaws on the one hand and from the joint on the other hand to grip the hair between the connection and the jaws in the closed position. By this arrangement, the hair is gripped more firmly.

Figure 13:
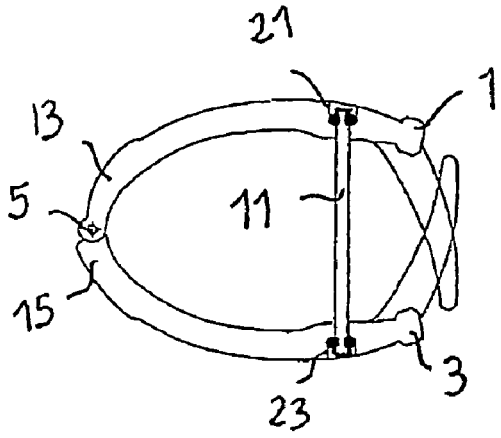
FIGS. 13 to 15 correspond to FIGS. 10 to 12 for a grip distinguished by the omission of the lever arms.
Figure 15:
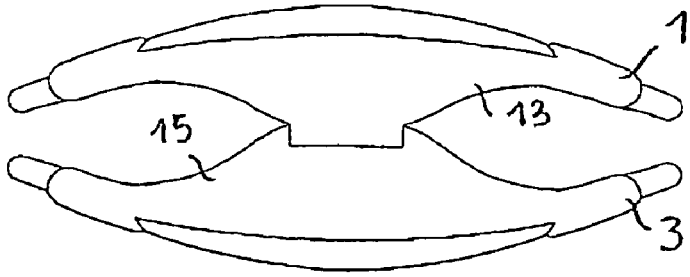
Figure 14:
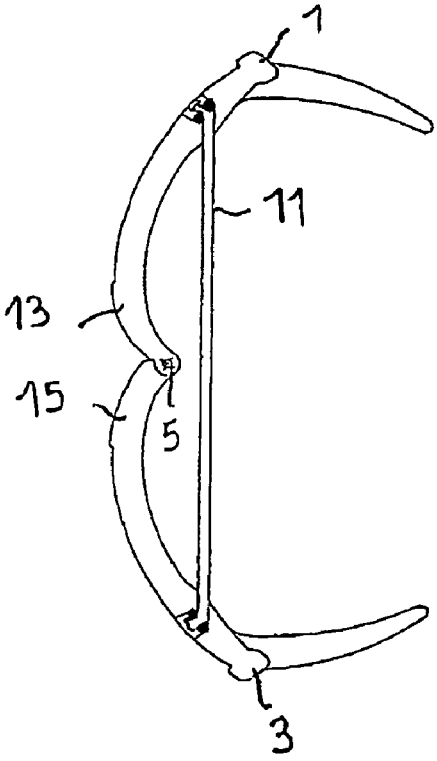
Figure 16:
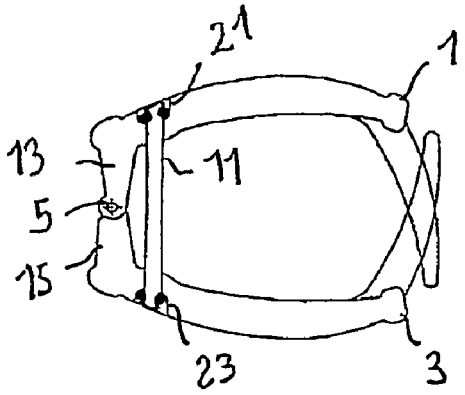
FIGS. 16 to 18 show a hair grip according to a second embodiment of the invention, respectively as a profile view, in the closed position and in the open position, and as a rear view, in the closed position. The grip shown by these Figures has a joint with two pins and a connection crossing the joint through the passage created between the two pins to stabilise the grip in the open position.

The hair grip shown by FIGS. 13 to 15 is distinguished from the grip described in FIGS. 10 to 12 by the lever arms having been omitted.

According to a second embodiment of the invention, shown by FIGS. 16 to 24, the two jaws 1 and 3 are articulated by two coaxial pins 61 and 62 or by two coaxial cylindrical linkages 81 and 82 to create between them a passage allowing the connection 11, when the two jaws are displaced from the closed position to the open position, to pass between the coaxial pins or between the two coaxial cylindrical linkages to exert a return force for returning the two jaws to the open position.

Figure 18:
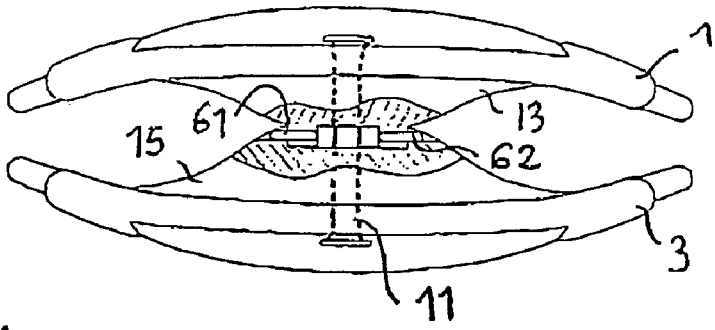
Figure 17:
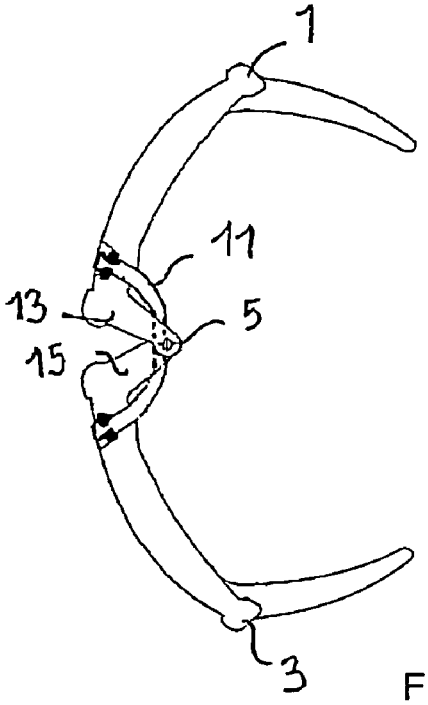
Figure 19:
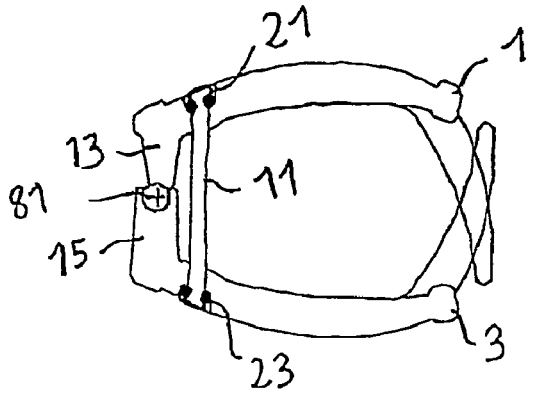
FIGS. 19 to 21 correspond to FIGS. 16 to 18 for a grip distinguished by a joint with two cylindrical linkages.
Figure 21:
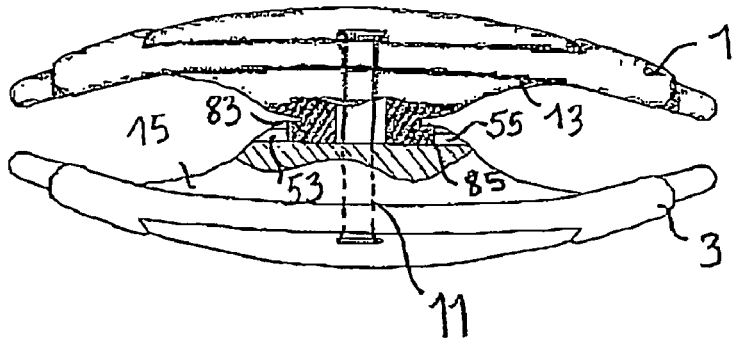
Figure 20:
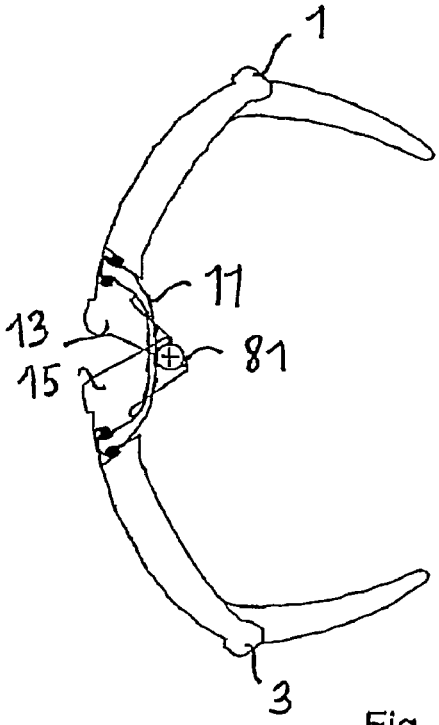

In other words, the joint formed by the two coaxial pins or the two coaxial cylindrical linkages allows the connection to cross the joint perpendicular to the direction of articulation of the two coaxial pins or the two coaxial cylindrical linkages, when opening the grip, to stabilise the grip in the open position, as is visible in FIGS. 18 and 21.

By this arrangement, the grip is held in the open position by the connection to allow the user to position it better on the hair. Once in position, the user can easily close the grip again into the closed position.

It is provided to articulate the two jaws by a joint part carrying two pairs of coaxial pins or two pairs of cylindrical linkages. One such embodiment applies equally well to the first as to the second embodiment.

Figure 22:
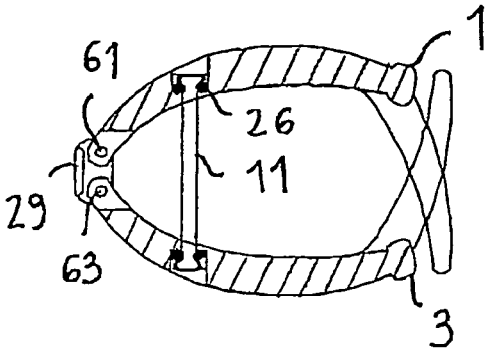
FIGS. 22 to 24 correspond to FIGS. 16 to 18 for a grip distinguished by a double joint with two pairs of coaxial pins carried by a joint part.
Figure 24:
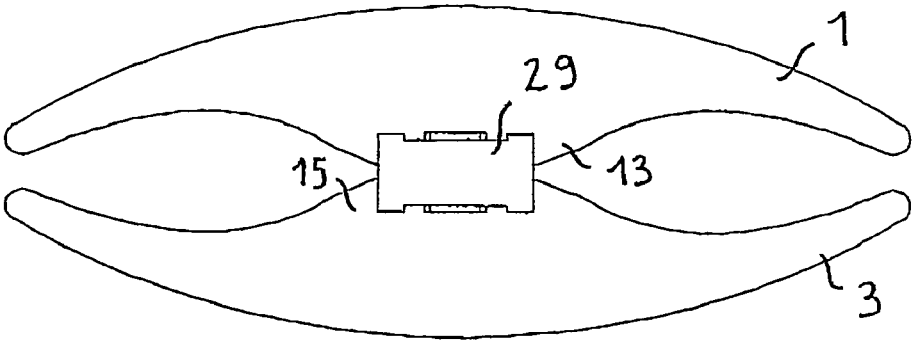
Figure 23:
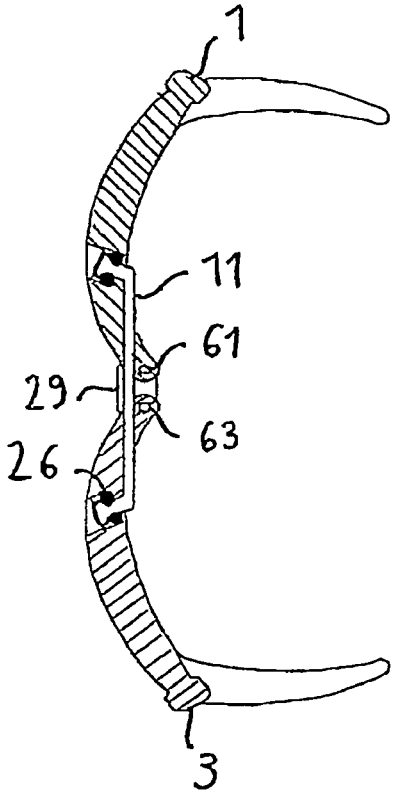
Figure 25:
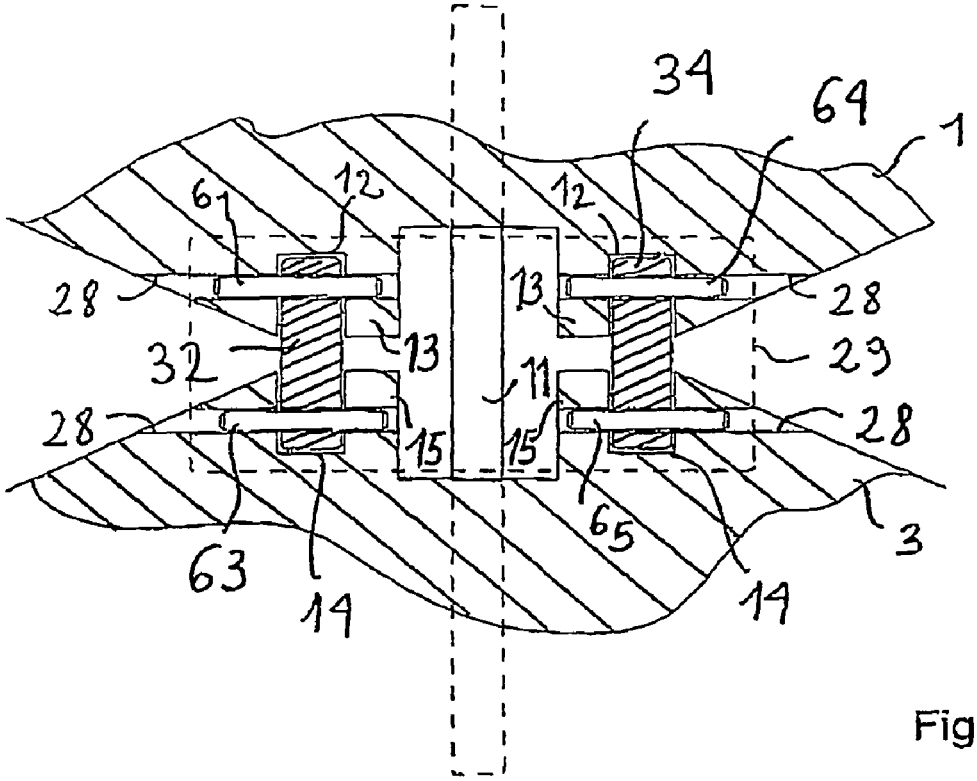
FIG. 25 is an enlargement of FIG. 24.
Figure 26:
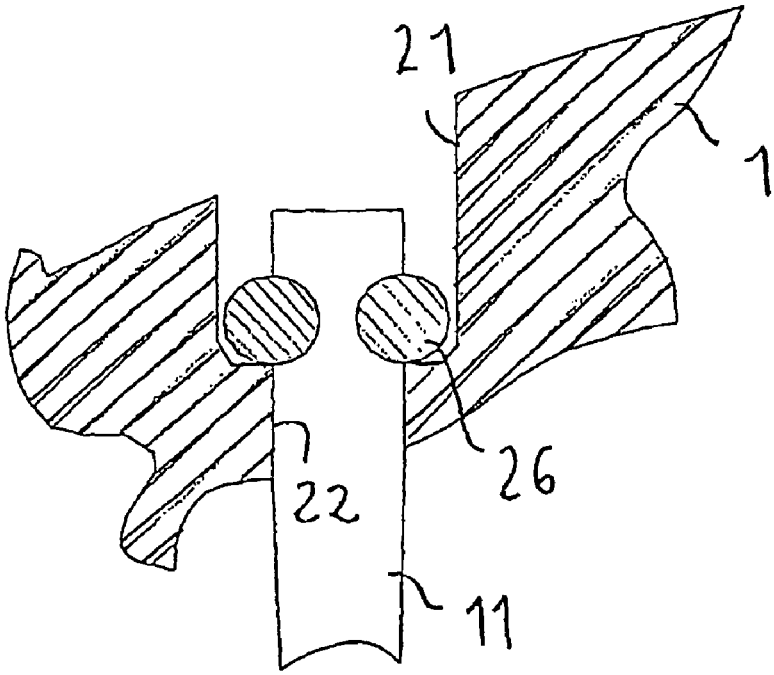
FIG. 26 is a view in section and in detail of a means of fixing the connection to the jaws of the hair grip according to the first or second embodiment of the invention.

For the application to the second embodiment, FIGS. 22 to 24, the two jaws 1 and 3 are articulated by means of a joint part 29 carrying a first pair of coaxial pins 61, 62 to articulate one 1 of the two grips and a second pair of coaxial pins 63, 64 to articulate the other grip 3. The two pairs are arranged on the joint part so as to allow the connection 11 to cross the two pins of each pair, FIG. 23, to stabilise the grip in the open position. Each of the joint pins 61 to 64 is mounted with a force fit in perforations 28 of two pin supports 32 and 34 of the joint part 29 and pin supports 13 and 15 of the two jaws. The pin supports 32 and 24 of the joint part 29 are received in corresponding housings 12 and 14 formed in pin supports 13 and 15 of the two jaws 1 and 3.

For the application to the first embodiment, the joint part carries two parallel pins, each dedicated to the articulation of one of the two jaws. In the open position, the connection comes into contact with the two parallel pins carried by the joint part to undergo an increase in deformation in elongation.

The pin supports or the cylindrical linkage supports 13 and 15 described in the first embodiment also apply to the second embodiment. In particular, in the stable open position, FIG. 18, 21 or 23, the two pin supports 13 and 15, each fixed to a jaw 1 or 3, are in abutment against one another or in abutment against the intermediate joint part 29. Similarly, the cylindrical linkage 51 described in the first embodiment also applies to the two coaxial cylindrical linkages 81 and 82 of the second embodiment. In particular, each cylindrical linkage 51, 81, 82 comprises a first cylinder 53, 83 fixed to one 1 of the two jaws and projecting to be inserted by resilient gripping into a second cylinder 55, 85 formed with a hollowed out portion in the other jaw 3 or in the intermediate joint part 29.

According to a third embodiment of the invention, shown by FIGS. 29 to 33, the two jaws 1 and 3 are articulated by a pin 5. A self-closing connection 12 connects the two jaws to exert a return force by deformation in elongation against the displacement of the two jaws relative to the joint pin 5 from the closed position shown by FIG. 29 to the open position shown by FIG. 30, in order to return the two jaws to the closed position.

The jaws are displaced by means of lever arms 7 and 9, each fixed to a jaw.

Figure 31:
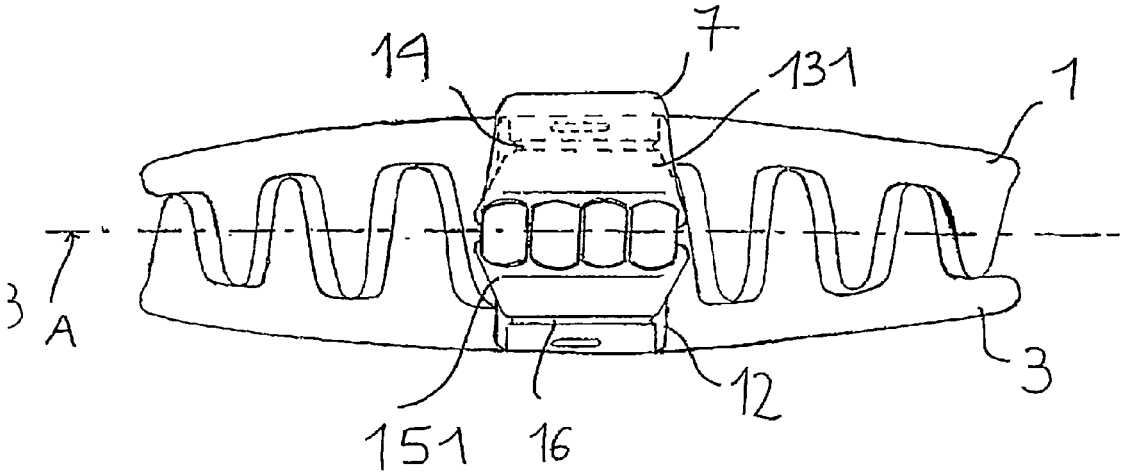

The self-closing connection 12 connects the two jaws by being received in notches 18, 20 formed in two joint supports 131, 151 which are fixed to the jaws 1, 3 by two feet 133, 153 joined together by two heads 135, 155 which extend in the joint direction A over the feet 133, 153 to mask the connection 12 in the closed position, FIG. 31.

Figure 32:
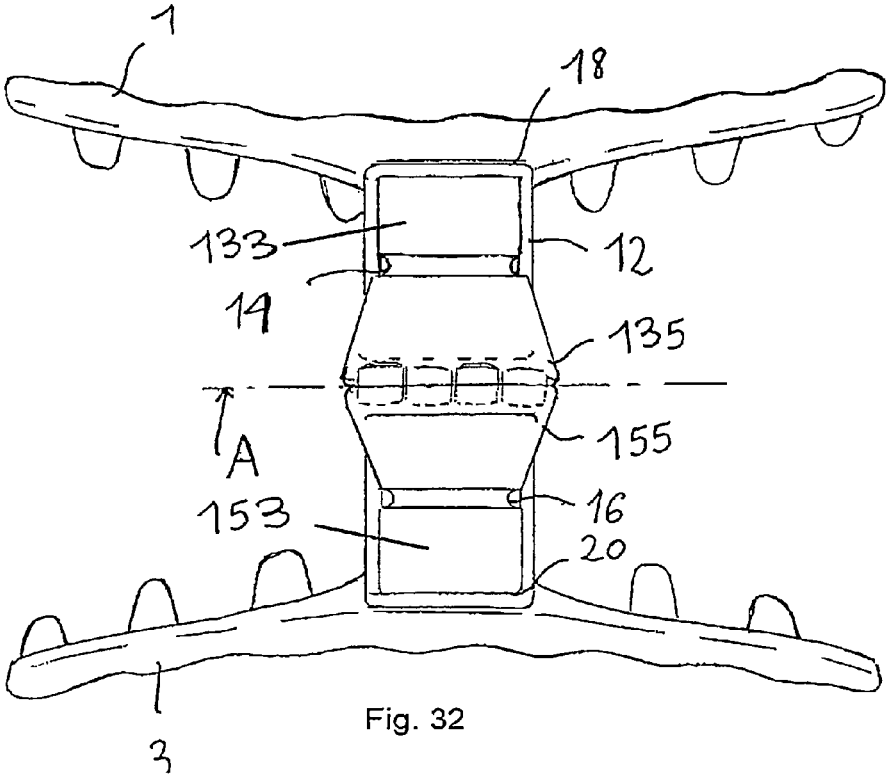
Figure 33:
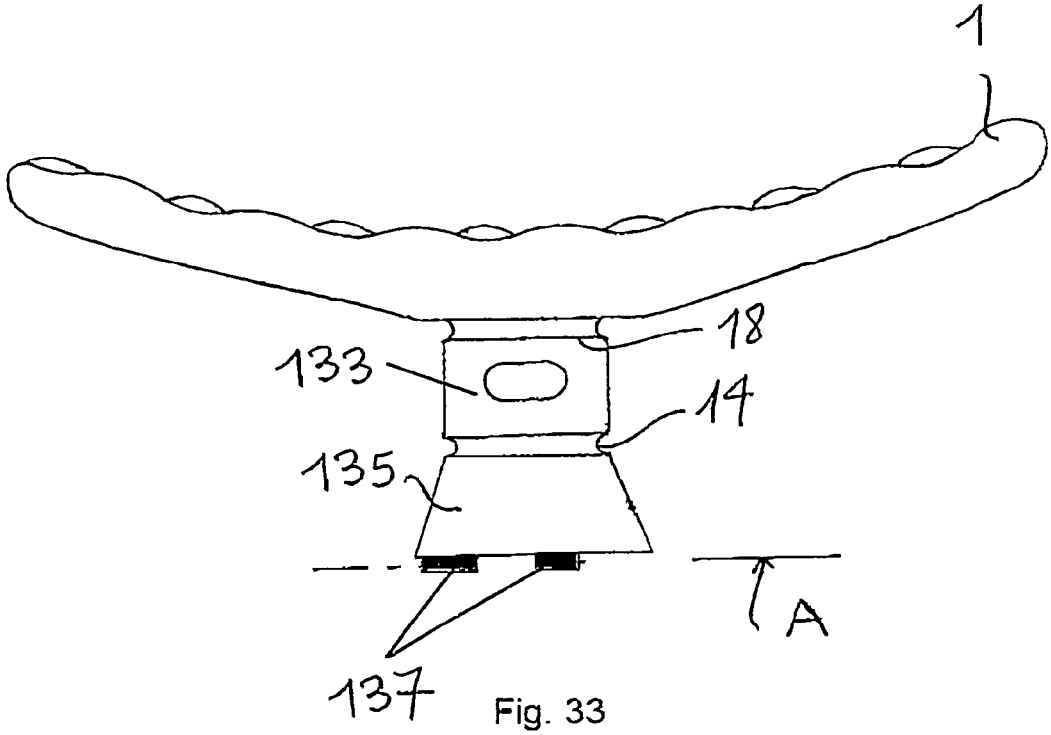
Figure 38:
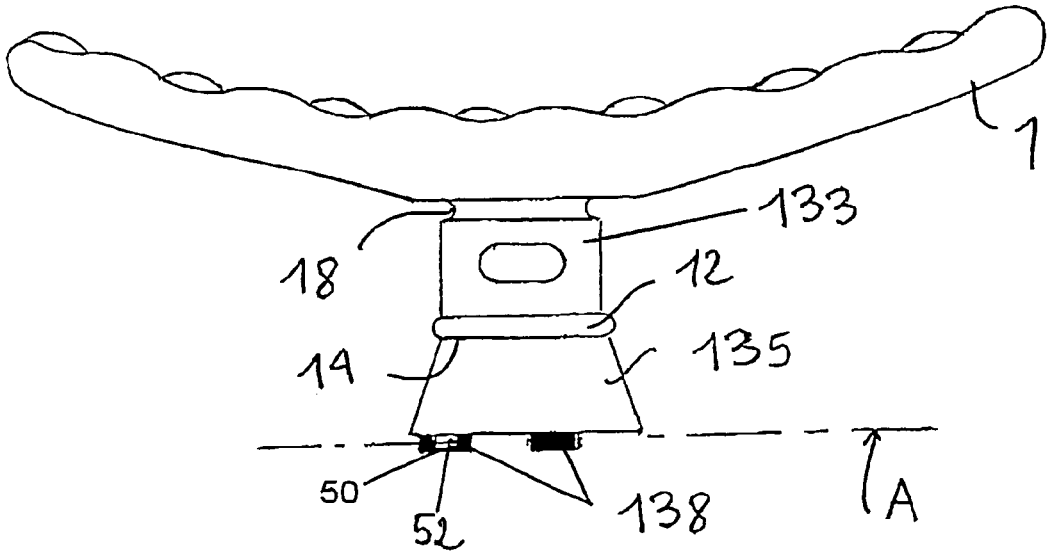
FIGS. 34 to 38 show a hair grip according to a fourth embodiment of the invention, respectively as a profile view, in the closed position and in the open position, as a rear view in the closed position, as a view from above in the open position and one of the jaws constituting a grip, as a plan view. The grip shown by these Figures has a joint pin and a self-closing connection crossing the joint to stabilise the grip in the open position.

As is visible in FIGS. 31, 32 and 33, the joint pin 5 is inserted in the joint direction A into hinge elements 137, 157 fixed to or integrated in the heads 135, 155 of the joint supports 131, 151.

Preferably, the connection 12 is arranged relative to the jaws 1 and 3 so as to grip the hair of the user in the closed position. Thus the notches 18, 20 are formed, FIG. 30, at one end of the foot 133, 153 of the joint supports 131, 151 forming an interface with each jaw to distance the connection 12 from the joint pin 5.

Alternatively, to obtain an increase in deformation of the connection 12 in the open position, it is provided to form notches 14, 16 at one end of the foot 133, 153 of the joint supports 131, 151 forming an interface with each head 135, 155 of these joint supports to bring the connection 12 into contact with the joint pin 5 in the open position.

In this third embodiment, the two heads 135, 155 of the joint supports 131, 151 may also be articulated by a cylindrical linkage or by a double joint by means of a joint part such as described above for the first and second embodiments and more particularly shown by FIGS. 22 to 25. The jaws can be provided with integral or attached lever arms.

According to a fourth embodiment of the invention, shown by FIGS. 34 to 38, the two jaws 1 and 3 are articulated by a joint pin 54. A self-closing connection 12 connects the two jaws to exert a return force by deformation in elongation against the displacement of the two jaws 1 and 3 relative to the joint pin 54 from the closed position shown by FIG. 34 into the open position shown by FIG. 35 in order to return the two jaws 1 and 3 to the closed position.

Figure 34:
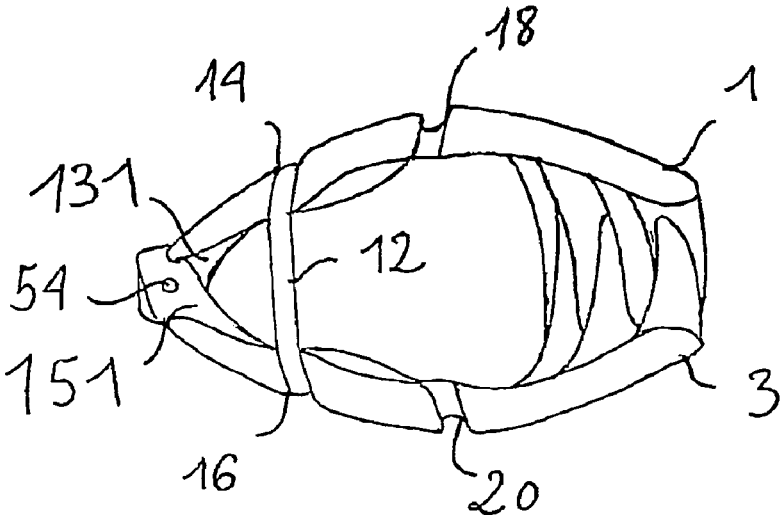
Figure 35:
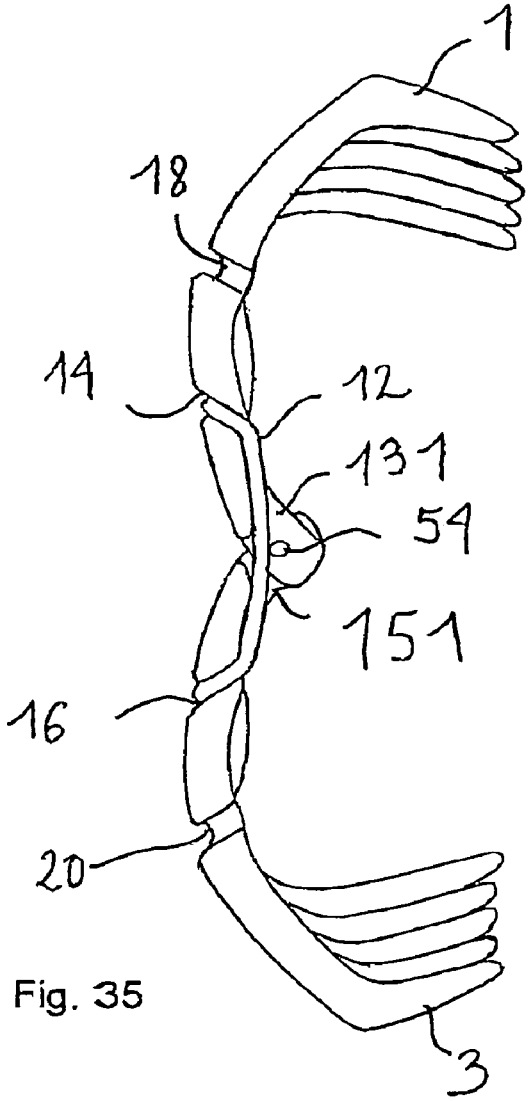

As is visible in FIGS. 34 and 35, the joint pin 54 is inserted into hinge elements 138, 158 fixed to the joint supports 131, 151 each fixed to the jaws 1 and 3. One of the hinge elements of each support is provided with an aperture 52, 56 to allow the connection 12, when the jaws are displaced from the closed position, FIG. 34, into the open position, FIG. 35, to cross the joint pin 54 by being received in recesses 52, 56 to exert a return force for returning the two jaws to the open position. Here again, the connection 12 crosses the joint perpendicular to the joint pin A. Preferably, the apertures 52, 56 are only open on one side and are closed on an opposing side by a cover 50 to hide the connection 12.

Figure 36:
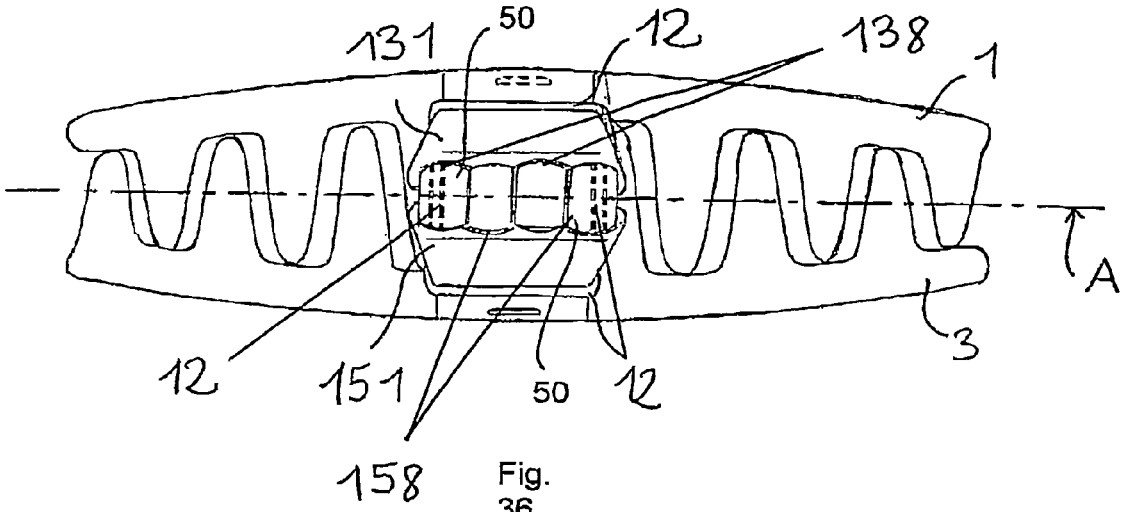
Figure 37:
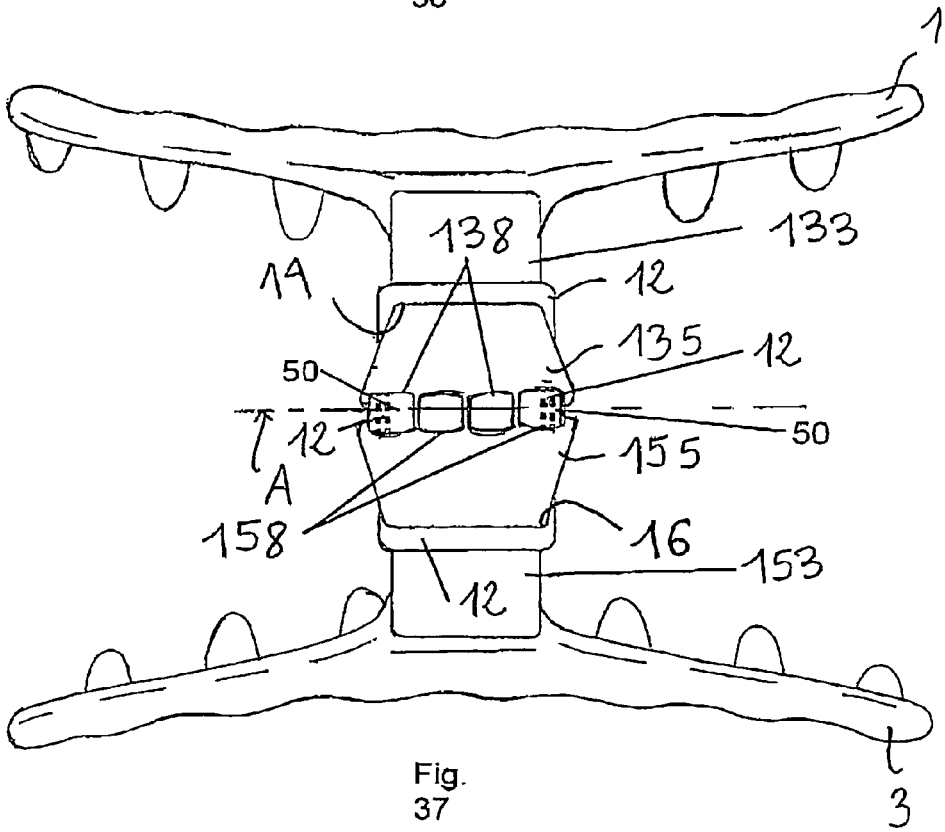

Preferably, the self-closing connection 12 connects the two jaws by being received in notches 18, 20 formed in the two joint supports 131, 151, which are attached to the jaws 1, 3 by two feet 133, 153 and articulated by two heads 135, 155 which extend in the joint direction A above the feet 133, 153 to mask the connection 12 in the closed position, FIG. 36. A small fraction of the connection 12 remains visible through the apertures 52, 56 which can be reduced to increase the masking of the connection.

Preferably also, the connection 12 is arranged relative to the jaws 1 and 3, so as to grip the hair of the user in the closed position. Thus the notches 18, 20 are formed, FIG. 38, at one end of the joint supports 131, 151 forming an interface with each jaw to distance the connection 12 from the joint pin 5.

The joint pin 54, provided for the grip according to the fourth embodiment of the invention, may be replaced by a cylindrical linkage of the type described for example for the first and second embodiments of the invention. Similarly, a joint part of the type described in relation to these embodiments also applies to a grip according to this fourth embodiment by adapting it to form the lateral apertures necessary to allow the self-closing connection 12 to cross, when opening the grip, two pins or two cylindrical linkages carried by this joint part in order to stabilise the grip in this open position.

Figure 39:
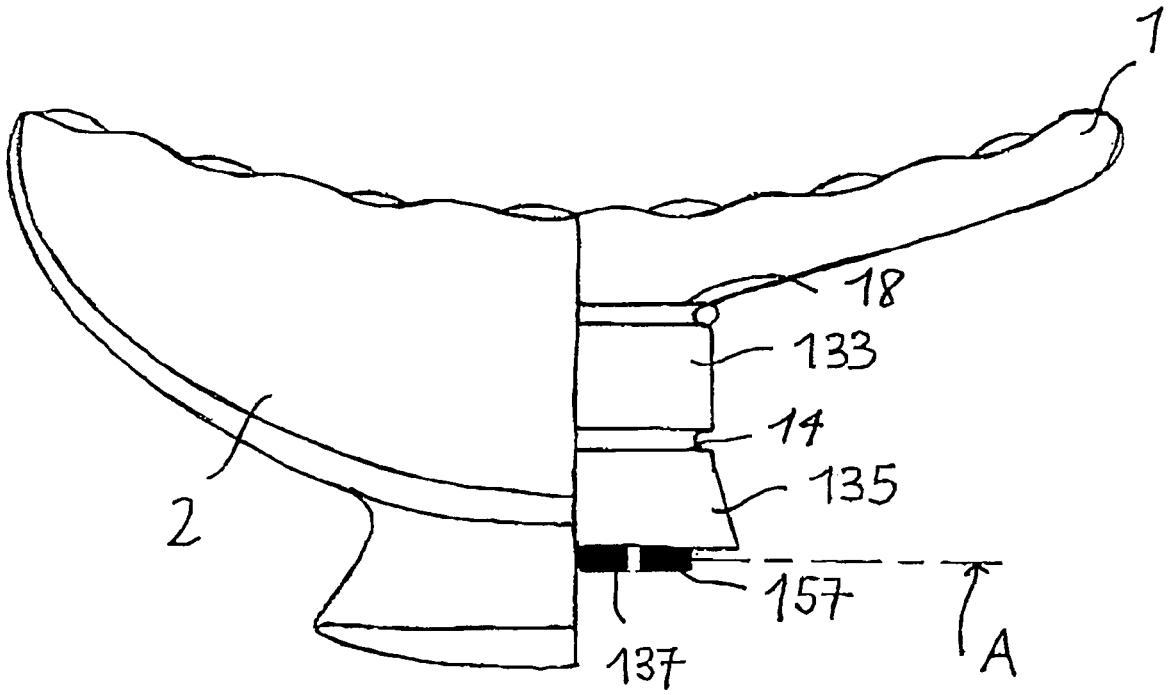
FIG. 39 shows an embodiment of a grip comprising a framework and two shell portions.

It is noteworthy that the grip described in the different embodiments of the invention, where the lever arms have been omitted, can be considered as a framework on which it is possible advantageously to arrange a shell portion serving, for example, as a lever arm or serving to mask the resilient connection completely, in particular in the fourth embodiment described above. FIG. 39 shows an embodiment of a grip comprising a framework in accordance with the fourth embodiment of the invention and two shell portions mounted respectively on the jaws 1 and 3.

The connection, whether self-closing or not, is planar or cylindrical and produced in an elastomer material, for example rubber or polyurethane. Preferably, this material has a Shore A hardness of between 60 and 90.

In an embodiment of the invention not shown, it is provided to replace the connection made of an elastomer material by a helical spring fixed at its ends onto each jaw. The helical spring can also be self-closing in a loop.

The hair grip according to the invention is produced, for example, by the injection of thermoplastic material, the lever arms, if they are present, being formed integrally or not with the jaws. It is also provided to produce said hair grip by machining and thermoforming.

The hair grip according to the invention allows the jaws or the lever arms to be arranged with greater freedom to give any aesthetic form to the jaws or to the arms and thus to increase the possibilities of styles. In a particular arrangement, the connection is advantageously used to grip the hair against the jaws and thus improve the grip on the hair of the user. In a further arrangement, the connection advantageously crosses the joint to stabilise the grip in the open position and thus increase the ease of positioning, whilst omitting the lever arms of the jaws. Combined with the masking of the connection, in particular in the closed position, the hair grip according to the invention has a high aesthetic value.

The invention claimed is:

1. Hair grip comprising:

two jaws articulated about a joint for relative displacement into an open or closed position, each of the two jaws having an inner face facing the other jaw and an outer face opposed to the other jaw, and an elongated connection having two respective free end portions, wherein said elongated connection is tensioned between the two jaws so as to exert a return force by a deformation in elongation of the connection against the displacement of the two jaws from the closed position to the open position in order to return the two jaws to the closed position, wherein the connection is produced in an elastomer material having a Shore A hardness of between 60 and 90, wherein each of the two jaws is provided with a perforation, wherein at least a portion of each respective perforation has a cross-section having a first dimension and at least a second portion having a second dimension larger than the first dimension, wherein each of the respective free end portions of the connection passes through the respective portion of perforation having the respective first dimension, wherein a respective U-shaped clip is attached to the respective free end portion of the connection on a side of the respective first portion of perforation having the respective first dimension opposed to the inner face of the respective jaw, and wherein said respective U-shaped clip has a respective third dimension larger than the respective first dimension and not larger than the second dimension, so that said respective U-shaped clip is prevented from passing through the respective first portion of perforation having the respective first dimension when the jaws are opened.

2. Hair grip according to claim 1, wherein the two jaws are articulated by means of a joint part carrying a first pin, a first cylindrical linkage or a first pair of coaxial pins or cylindrical linkage to articulate one of the two jaws and a second pin, a second cylindrical linkage or a second pair of coaxial pins or cylindrical linkages to articulate the other jaw.

3. Hair grip according to claim 1, wherein the connection is arranged so as to undergo increased deformation in elongation in contact with the joint whilst the two jaws are displaced into the open position.

4. Hair grip according to claim 1, wherein the two jaws are displaced by means of two lever arms each fixed to a jaw and arranged on the side opposing the connection relative to the joint.

5. Hair grip according to claim 4, wherein the U-shaped clips received in the notches are masked to enhance the aesthetic character of the hair grip.

6. Hair grip according to claim 5, wherein the lever arms are provided as a separate part attached to the jaws, and the U-shaped clips received in the notches are masked by a portion of the lever arms.

7. Hair grip according to claim 6, wherein the lever arms are attached to the jaws by resilient gripping of lugs in the notches.

8. Hair grip according to claim 1, wherein the connection is offset toward the jaws relative to the joint to grip the hair against the jaws in the closed position.

9. Hair grip according to claim 8, wherein the two jaws are articulated by two coaxial pins, by two coaxial cylindrical linkages or by a pin or a cylindrical linkage provided with two apertures formed on both sides of the pin or the cylindrical linkage to allow the connection to cross between the two coaxial pins or between the two coaxial cylindrical linkages or to cross the joint pin or the cylindrical linkage by being displaced in the apertures.

10. Hair grip according to claim 1, wherein the joint is provided with a passage to permit the connection to cross the joint once the two jaws are displaced from the closed position to the open position to exert a return force for returning the two jaws to the open position.

11. Hair grip according to any of claims 10 and 9, wherein the passage or apertures are closed by a cover to hide the connection.

12. Hair grip according to claim 10 or 9, wherein the connection is offset toward the jaws relative to the joint to grip the hair against the jaws in the closed position.

13. Hair grip according to claim 10 or 9, wherein the two jaws are displaced by means of two lever arms each fixed to a jaw and arranged on the side opposing the connection relative to the joint.

14. Hair grip according to claim 1, wherein each of the respective free end portions of the connection is retained in the respective jaw by the respective U-shaped clip, said U-shaped clip being received in a corresponding notch formed in the perforation of the respective jaw.

15. Hair grip according to claim 14, wherein each of the U-shaped clips is oriented transversally to a longitudinal direction of the connection and the corresponding notch is oriented transversally to a longitudinal direction of the respective perforation.

16. Hair grip according to claim 14, wherein the U-shaped clips received in the notches are masked to enhance the aesthetic character of the hair grip.

17. Hair grip according to claim 14, wherein each of the U-shaped clips received in the notches is masked by a shell portion serving as a lever arm.

18. Hair grip according to claim 17, wherein the U-shaped clips received in the notches are masked by a shell portion serving to mask the resilient connection completely.

* * * * *